US007856953B2

(12) United States Patent
Kirbach et al.

(10) Patent No.: US 7,856,953 B2
(45) Date of Patent: Dec. 28, 2010

(54) DUAL VALVE LIFTER ASSEMBLY

(75) Inventors: Lutz Kirbach, Rochester Hills, MI (US); Florin Bugescu, Canton, MI (US)

(73) Assignee: Schaeffler KG, Herzogenaurach (DE)

( * ) Notice: Subject to any disclaimer, the term of this patent is extended or adjusted under 35 U.S.C. 154(b) by 357 days.

(21) Appl. No.: 12/169,822

(22) Filed: Jul. 9, 2008

(65) Prior Publication Data

US 2009/0013950 A1 Jan. 15, 2009

Related U.S. Application Data

(60) Provisional application No. 60/948,729, filed on Jul. 10, 2007.

(51) Int. Cl.
*F01L 1/14* (2006.01)

(52) U.S. Cl. ..... 123/90.5; 123/90.48; 123/90.52; 123/90.55

(58) Field of Classification Search ..... 123/90.59, 123/90.55, 90.52, 90.5, 90.48
See application file for complete search history.

(56) References Cited

U.S. PATENT DOCUMENTS

2006/0278184 A1* 12/2006 Barth et al. ..... 123/90.5

* cited by examiner

*Primary Examiner*—Zelalem Eshete
(74) *Attorney, Agent, or Firm*—Lucas & Merchati, LLP

(57) ABSTRACT

The dual valve lifter assembly has a dual valve lift with two hydraulic lash adjusters therein and a guide for orienting and preventing rotation of the dual valve lifter. The guide has four ledges and the dual valve lifter has four flats which mate with the four ledges. The flats and the ledges prevent the rotation of the lifter. One pair of flats and one pair of ledges are spaced the same while the other pair of flats and the other pair of ledges are spaced at a different distance than the first pair of flats and ledges. The difference in the spacing of the pairs of ledges and flats allows for correct orientation of the lifter when mating it with the guide.

6 Claims, 6 Drawing Sheets

DUAL VALVE LIFTER ASSEMBLY

FIELD OF THE INVENTION

This invention relates to internal combustion engines and more particularly to the valve train arrangement for an internal combustion engine which uses dual valve lifters.

BACKGROUND OF THE INVENTION

As is conventional, internal combustion engines typically use a cam shaft which operates on a finger follower or a push rod in order to open and close the valves of the cylinder. In order to minimize lash, the cams and the push rods or finger followers use a hydraulic element, conventional referred to as a hydraulic lash adjuster. In one typical arrangement, the hydraulic lash adjuster is positioned between the cam follower and the push rod/finger follower.

As is conventional, cylinders of internal combustion engines often have four or more valves. These valves are typically positioned in groups of two or more and can be operated simultaneously for either intake or exhaust. In such an engine, two or more hydraulic lash adjusters can be housed in a common housing which is operated on by a single cam. One end of the housing has a cam follower while the other end of the housing is open to allow for the push rods or the finger followers to mate with the hydraulic lash adjuster.

One of the problems faced in this field is the proper orientation of the hydraulic lash adjuster as well as preventing the rotation of the hydraulic lash adjuster as it is operated on by the cam. One solution to this problem is to modify the exterior housing of the lash adjuster either to provide a flat surface or to provide an axial groove an pin like arrangement between the outer housing of the lash adjuster and the bore in which the adjuster is housed. Conventional hydraulic lash adjusters have cylindrical outer housings which do not conventional contain flats, pins or grooves. Additionally, hydraulic lash adjusters generally have outer housings which are made of metal. Thus, it can be expensive to make special hydraulic lash adjusters and to maintain an inventory of hydraulic lash adjusters having the special designs.

There is a need to simplify the design employed for maintaining the orientation and preventing the rotation of the hydraulic lash adjusters.

OBJECT OF THE INVENTION

It is the object of the present invention to provide an improved design which maintains the orientation and prevents the rotation of the lift assembly. These and other objects of the present invention will become more readily apparent by reference to the following description.

SUMMARY OF THE INVENTION

The present invention achieves the objects by using two pairs of flats on the common housing of a dual valve lifter and two pairs of ledges on the guide which is mounted on the engine block. One pair of flats on the dual valve lifter is aligned with one pair of ledges on the guide while the other pair of flats on the dual valve lifter aligns with the other pair of ledges on the guide. Each of the respective pairs of flats and ledges is spaced differently so that the guide and the dual valve lifter can only be installed in a single manner.

Broadly, the present invention can be defined as follows:

a dual valve assembly for internal combustion engines comprising:

a dual valve lifter and a guide for said dual valve lifter;

said dual valve lifter comprising, an elongated outer housing, a cam follower mounted at one end of said outer housing, a first and second bore in said outer housing, said first and second bore each having an opening at the other end of said outer housing, a first and second flat adjacent said opening of said first bore, said first bore positioned between said first and second flat, a third and fourth flat adjacent said opening of said second bore, said second bore positioned between said first and second flat, a distance between said first and second flat different than a distance between said third and fourth flat, said first, second, third, and fourth flat each having a flat surface that define a plane and each plane of each flat being parallel to each other and parallel to a plane containing both axes of said first and second bore;

said guide having a plate adapted to be fixed to an engine block, a first and second hole in said plate, said first hole concentric with said first bore and said second hole concentric with said second bore, a first and second ledge extending downward from said plate and adjacent said first hole, said first hole positioned between said first and second ledge, a third and fourth ledge extending downward from such plate and adjacent said second hole, said second hole positioned between said third and fourth ledge, a distance between said first and second ledge different than a distance between said third and fourth ledge, said first, second, third, and fourth ledge each having a flat surface that define a plane and each plane of each ledge being parallel to each other and parallel to the plane containing both axes of said first and second bore;

wherein said dual lifter is oriented to and prevented from rotating by said guide because the flat surface of said first, second, third, and fourth flat align with the corresponding flat surface of said first, second, third, and fourth ledge.

Preferably, the first and third ledge are connected to form a continuous ledge and the second and fourth ledge are connected to form a continuous ledge.

The flats of the dual valve lifter are located on the outer surface of the dual valve lifter and, more specifically, on a structure which extends above the dual valve lifter. Specifically, the dual valve lifter can have a first and second sleeve wherein the first sleeve is mounted above, coaxial with, and cocircumferential with the first bore and the second sleeve can be mounted above, coaxial with, and cocircumferential with the second bore. In such case, the first and second flats are positioned on the outside of the first sleeve and the third and fourth flats are positioned on the outside of the second sleeve.

The flats face outwardly and the ledges face inwardly with respect to the housing. The distance between the first and second flat is different than the distance between the third and fourth flat. However, the distance between the first and second flat is preferably substantially the same as the distance between the first and second ledge. Likewise, the distance between the third and fourth flat is preferably substantially the same as the distance between the third and fourth ledge. By spacing the first and second flat away from each other at a distance that is different than the distance used to space the third and fourth flat, the dual valve lifter can be properly oriented in the guide. By employing two pairs of flats for each dual valve lifter and corresponding ledges with flat surfaces that mate with the flats, unwanted rotation of the dual valve lifter is avoided.

Preferably, the outer elongated housing is cylindrical and has an axis parallel to the axis of each bore.

These and other aspects of the present invention may be more readily understood by reference to one or more of the following drawings which are chosen for purposes of illustration only.

DETAILED DESCRIPTION OF THE DRAWINGS

Figure 1:
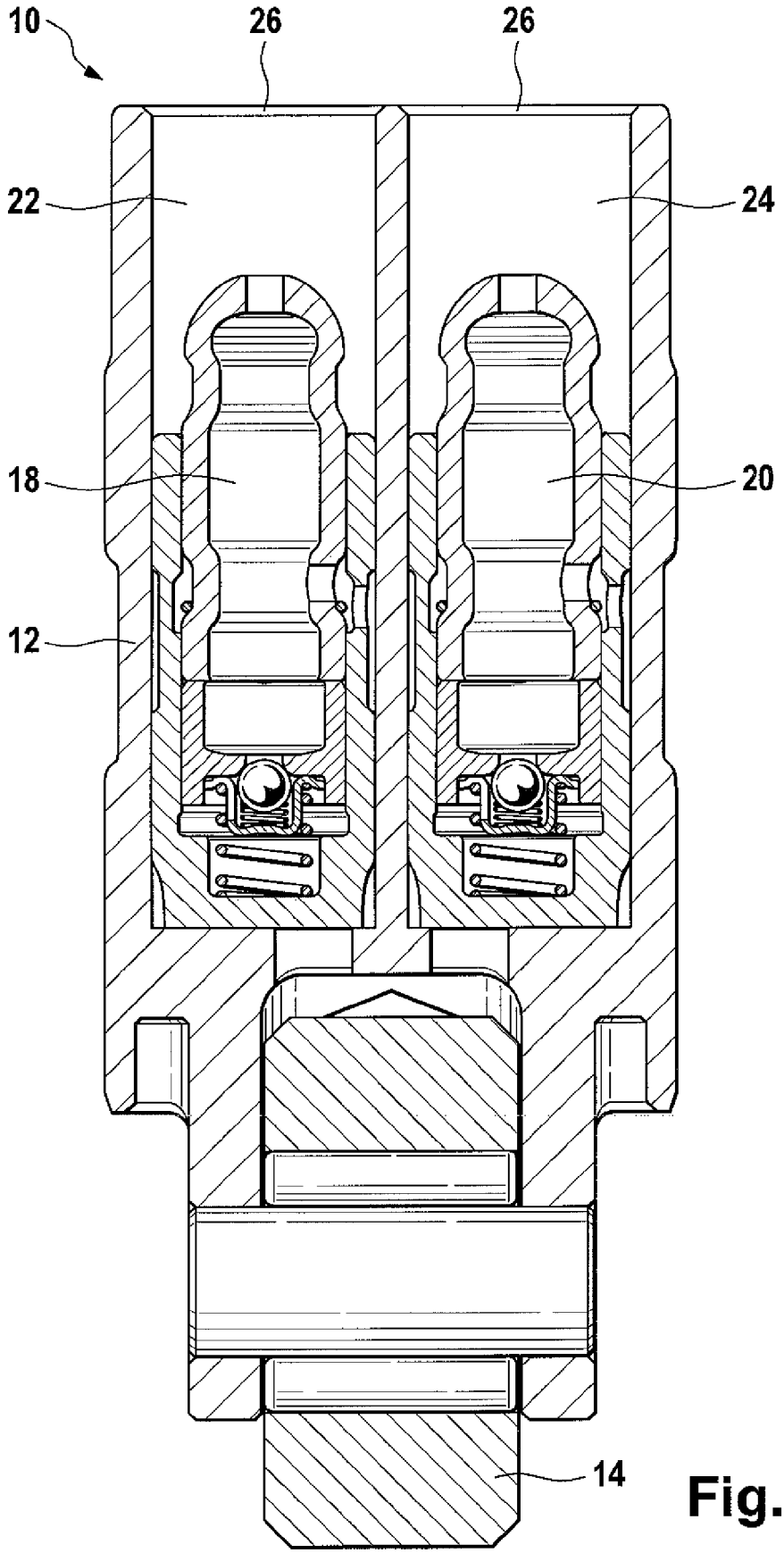
FIG. 1 is a cross section of a dual valve lifter.

FIG. 1 illustrates dual valve lifter 10 having outer elongated housing 12, and cam follower 14 mounted at one end. Cam follower 14 is illustrated as a roller. Outer housing 12 is typically cylindrical in shape as is more apparent from FIG. 2. Outer housing 12 has a conventional oil hole 16, see FIG. 2 where oil is fed from the oil train of the engine block to hydraulic lash adjusters 18 and 20 mounted in outer housing 12. Hydraulic lash adjusters 18 and 20 are specifically positioned within first and second bore 22 and 24. First and second bore each have respective openings 26 and 28. Openings 26, 28 allow for push rods or finger followers to be in contact with hydraulic lash adjusters 18 and 20.

Hydraulic lash adjusters 18 and 20 are operated in a conventional manner to control lash in an internal combustion engine.

Figure 2:
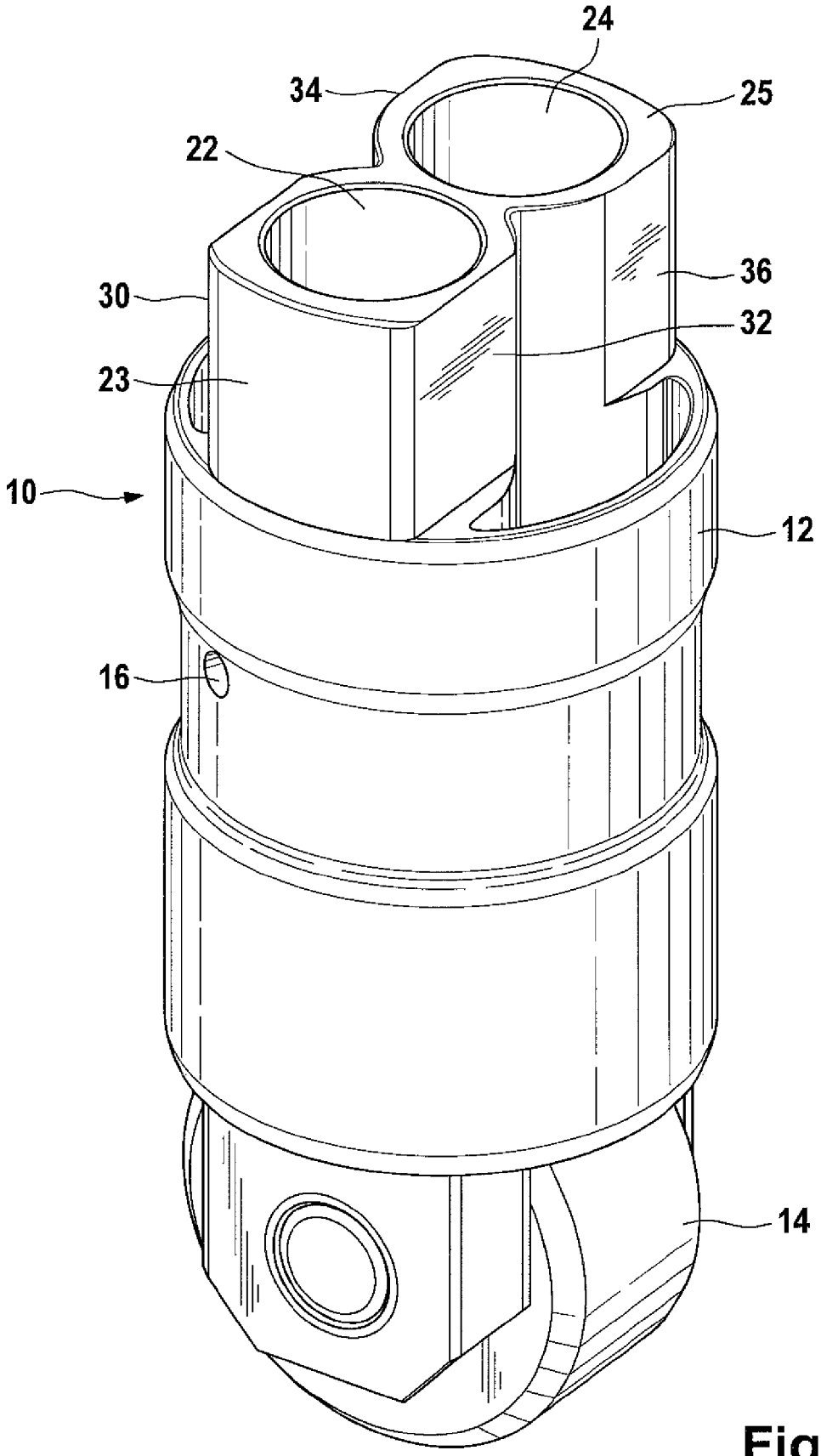
FIG. 2 is a perspective view of the outside of a dual valve lifter.

Turning to FIG. 2, it can be seen that first bore 22 is interposed between first and second flat 30 and 32. Second bore 24 is interposed between third flat 34 and fourth flat 36.

As can be seen in FIG. 2, bore 22 has sleeve 23 which extends upward from bore 22. Sleeve 23 is mounted above bore 22, coaxial with bore 22 and the inside of sleeve 23 has a bore with is cocircumferential with bore 22. Likewise, above bore 24 has sleeve 25. Sleeve 25 is mounted above bore 24, is coaxial with bore 24 and the inside of sleeve 25 is cocircumferential with bore 24. In essence, the inside bore of sleeve 23 forms an extension of bore 22 and the inside bore of sleeve 25 forms an extension of bore 24 as illustrated in FIG. 2.

Figure 3:
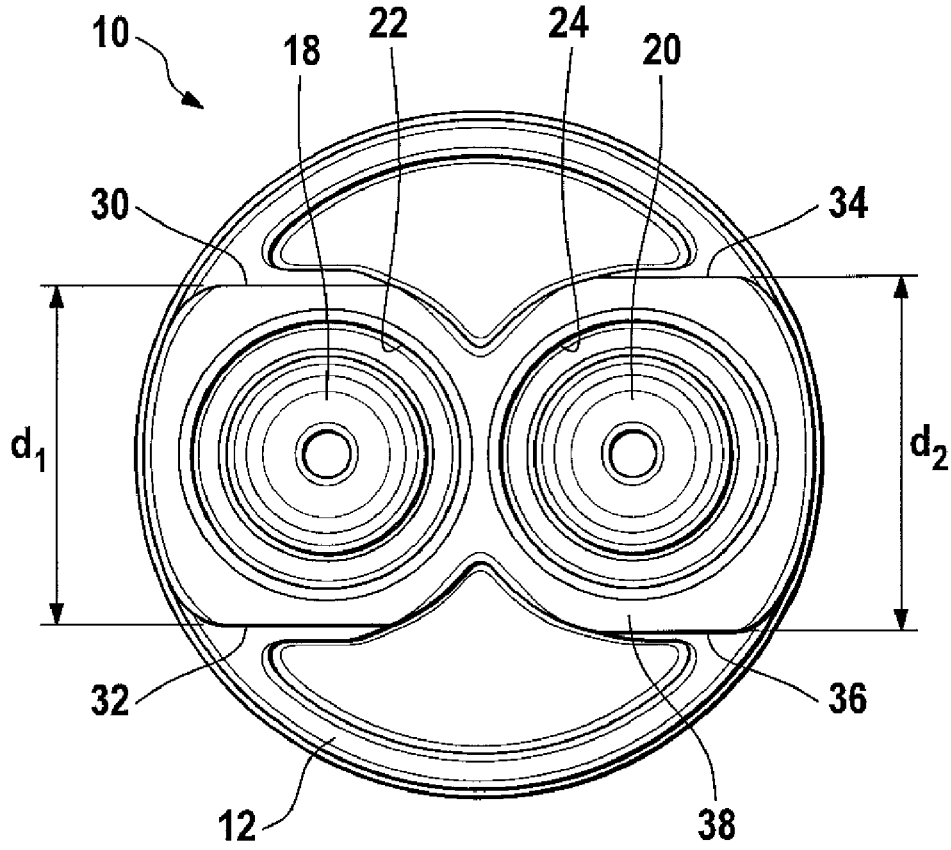
FIG. 3. is a top view of a dual valve lifter.

As can be seen from FIG. 3, which is a top view of dual valve lifter 10, the distance $d_1$ between first flat 30 and second flat 32 is different than the distance $d_2$ between third flat 34 and fourth flat 36. Specifically, $d_1$ is less than $d_2$.

Additionally, as can be seen by FIG. 3, the first, second, third, and fourth flat each form a flat surface that has a plane and the planes formed by each one of the flat surfaces are parallel to each other. These parallel planes are also parallel to the plane marked 38. Plane 38 contains both axes of first and second bore 22, 24 as shown in FIG. 3.

Figure 4:
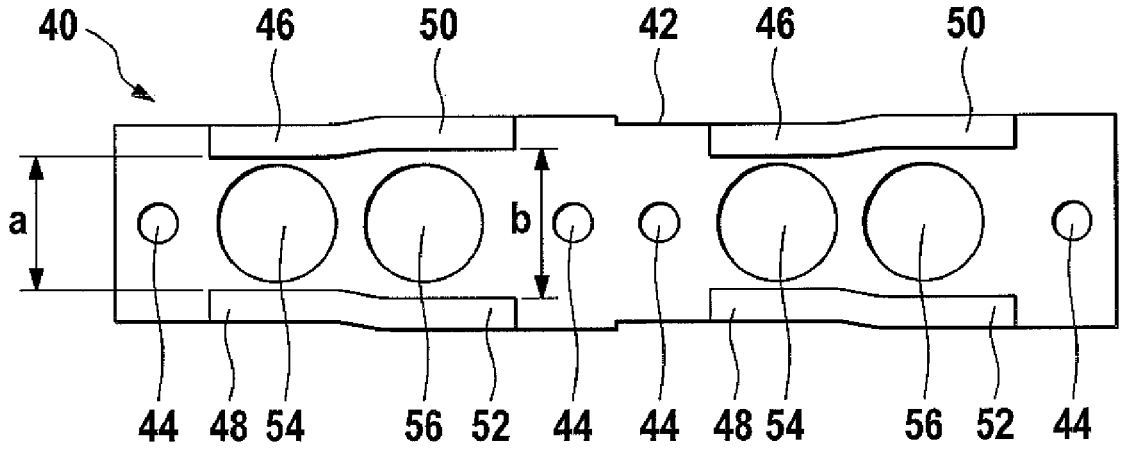
FIG. 4 is a bottom view of the guide.

FIG. 4 illustrates guide 40 having plate 42 with holes 44 for fixing to an engine block.

Extending from plate 42 is first ledge 46, second ledge 48, third ledge 50, and fourth ledge 52. First hole 54 is interposed between first ledge 46 and second ledge 48. Second hole 56 is interposed between third ledge 50 and fourth ledge 52. First hole 54 and second hole 56 allow for hydraulic lash adjusters 18 and 20 to come in contact with push rods or finger followers (not shown).

FIG. 4 also illustrates guide 40 for accommodating two adjacent dual valve lifters, although only one valve lifter needs to be accommodated with the guide of the present invention.

As illustrated in FIG. 4, distance a between first ledge 46 and second ledge 48 is different than distance b between third ledge 50 and fourth ledge 52. Preferably, distance a is less than distance b.

As will be appreciated, distance $d_1$ fits within distance a and distance $d_2$ fits within distance b such that first and second flat 30, 32 fit within first and second ledge 46, 48 and third and fourth flat 34, 36 fit within third and fourth ledge 50, 52. In order to accomplish this and to minimize rotational play between dual valve lifter 10 and guide 40, distance a is substantially similar to distance $d_1$ and distance b is substantially similar to distance $d_2$. In fact, it can be appreciated that the tighter the fit the better the fit.

Figure 5:
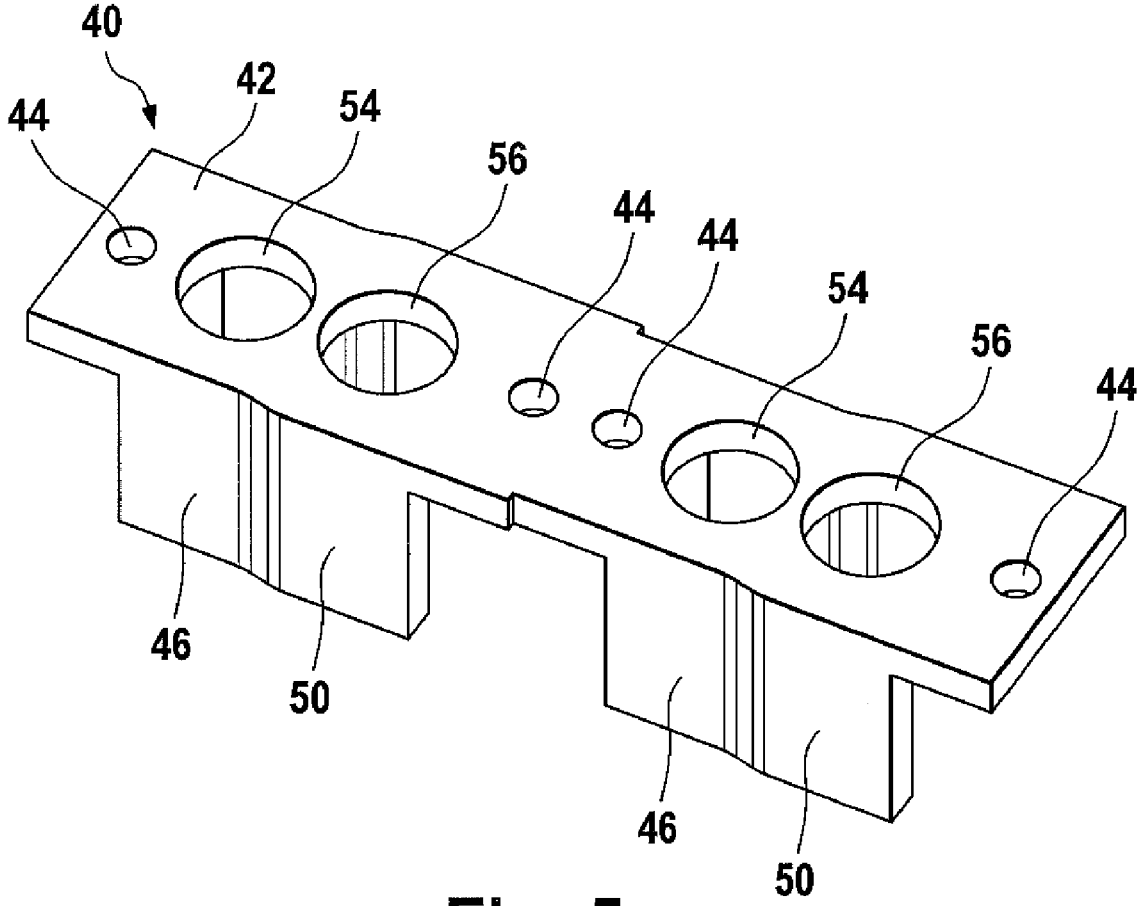
FIG. 5 is a perspective view of the guide.

Turning to FIG. 5, a perspective view of guide 40 is seen. It can also be seen in FIG. 5 that first and third ledge 46, 50 and second and fourth ledge 48, 52 are connected to form a continuous ledge. Perspective view in FIG. 4 shows guide 40 from a top view.

Figure 6:
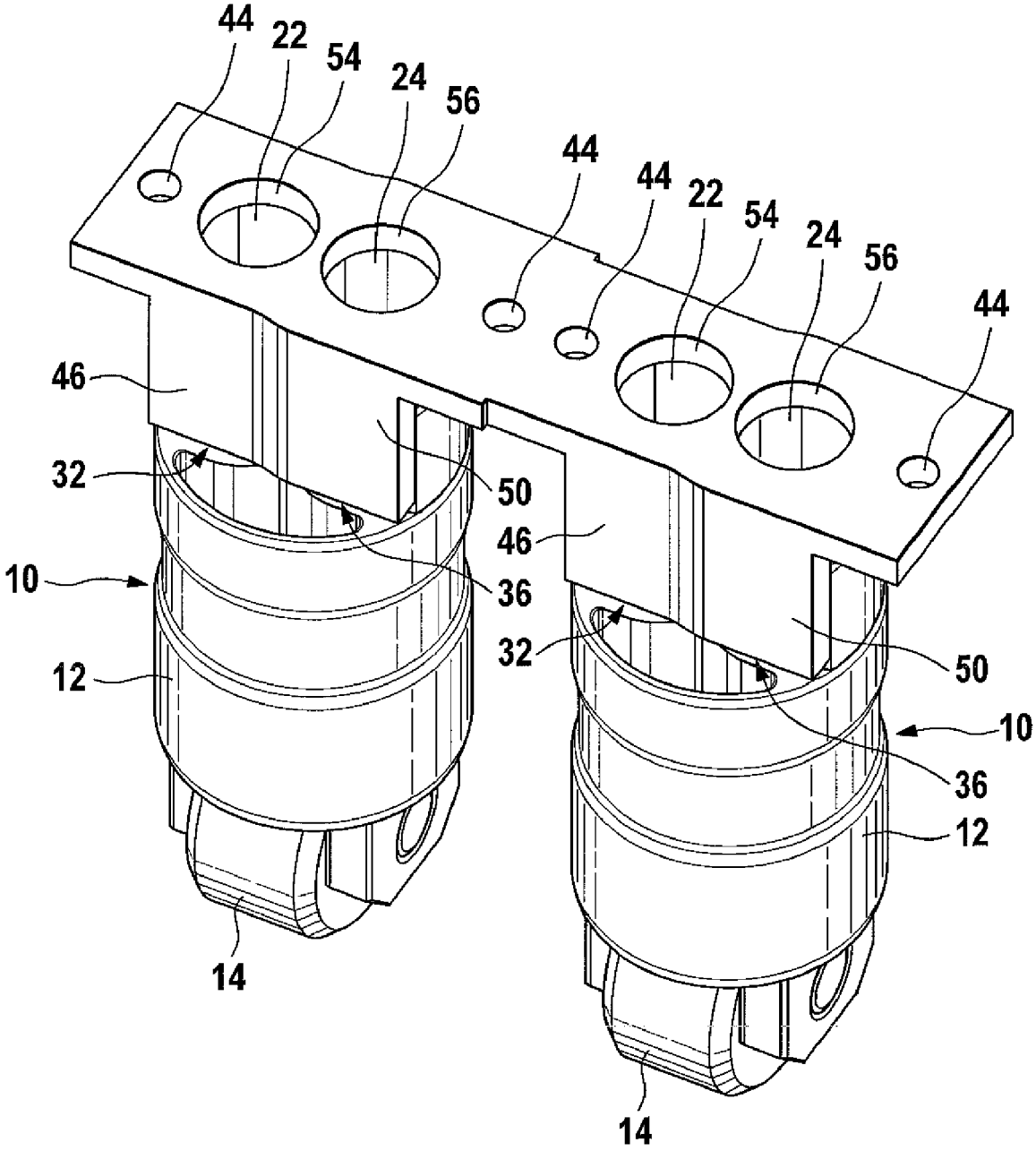
FIG. 6 is a perspective view of the dual valve lifter assembly where the flats and the ledges are outside the outer housing.

Turning to FIG. 6, it can be seen how two dual valve lifters 10 are aligned with guide 40. First and second flats 30, 32 align with first and second ledges 46, 48, while third and fourth flats 34, 36 align with third and fourth ledges 50 and 52 due to their different distances $d_1$, $d_2$, a, b. This aligning of the flats and the ledges prevents rotation of dual valve lifter 10 in guide lifter 40 and also because of the different distances between the pairs of flats/ledges require a specific orientation of dual valve lifter 10 in valve 40.

It can be seen in FIG. 6 that first hole 54 is concentric with first bore 22 and that second hole 56 is concentric with second bore 24.

In FIG. 6, first flat 30 and second flat 32 face outwardly to said outer housing and first ledge 46 and second ledge 48 face inwardly to said outer housing. These facing directions are based on the surfaces that are aligned with one another for the ledges and flats.

Figure 7:
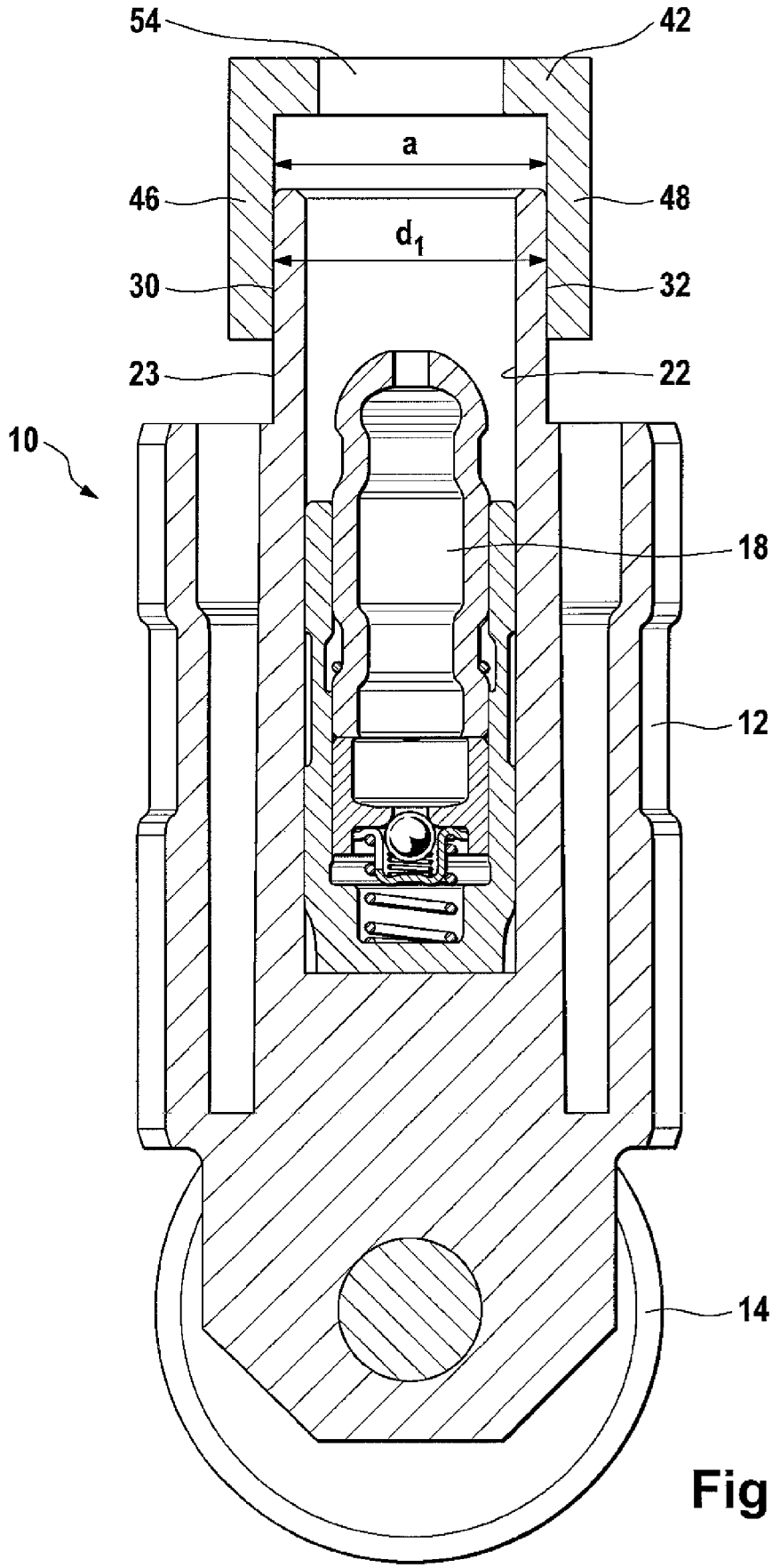
FIG. 7 is a cross sectional side view of the dual valve lifter assembly.

FIG. 7 illustrates a cross section through first bore 22 wherein both first and second flats 30, 32 are outside housing 12 and first and second ledge 46, 48 are also outside housing 12. As can be seen in FIG. 7, first ledge 46 and second ledge 48 both face inwardly to said housing and first flat 30 and second flat 32 face outwardly from said housing.

The guide can be made of metal or plastic in a conventional manner using conventional equipment. The outer elongated housing can be made from metal of plastic in a conventional manner using conventional equipment. The sleeves and bores for the hydraulic lash adjuster are preferably formed when the outer housing is made.

Although conventional lash adjusters have been depicted in the figures, switchable adjusters could also be employed without deporting from the invention. Furthermore, the flats and the ledges can be defined as axial flats and ledges since their flat surfaces are oriented in an axial direction with respect to the bores and the cylindrical outer housing.

REFERENCE CHARACTERS

10 Dual valve lifter
12 Outer elongated housing
14 Cam follower
16 Oil hole
18 Hydraulic lash adjusters
20 Hydraulic lash adjusters
22 First bore
23 Sleeve
24 Second bore
26 Opening
28 Opening
30 First flat
32 Second flat
34 Third flat
36 Fourth flat
38 Plane
40 Guide
42 Plate
44 Hole
46 First ledge
48 Second ledge
50 Third ledge
52 Fourth ledge
54 First hole
56 Second hole

What is claimed:

1. A dual valve lifter assembly for an internal combustion engine comprising:

a dual valve lifter and a guide for said dual valve lifter; said dual valve lifter comprising:

an elongated outer housing, a cam follower mounted at one end of said outer housing, a first and second bore in said outer housing, said first and second bore each having an opening at the other end of said outer housing, a first and second flat adjacent said opening of said first bore, said first bore positioned between said first and second flat, a third and fourth flat adjacent said opening of said second bore, said second bore positioned between said first and second flats, a distance between said first and second flat different than a distance between said third and fourth flat, said first, second, third, and fourth flat each having a flat surface that define a plane and each plane of each flat being parallel to each other and parallel to a plane containing both axes of said first and second bore;

said guide comprising a plate adapted to be affixed to an engine block, a first and second hole in said plate, said first hole concentric with said first bore and said second hole concentric with said second bore, a first and second ledge extending downward from said plate and adjacent said first hole, said first hole positioned between said first and second ledge, a third and fourth ledge extending down from said plate and adjacent said second hole, said second hole positioned between said third and fourth ledge, a distance between said first and second ledge different than a distance between said third and fourth ledge, said first, second, third, and fourth ledge each having a flat surface that define a plane and each plane of each ledge being parallel to each other and parallel to the plain containing both axes of said first and second bore;

wherein said dual lifter is oriented and prevented from rotation by said guide because of the alignment of said first, second, third, and fourth flat with said corresponding first, second, third, and fourth respective ledge.

2. The assembly of claim 1 wherein said first and third ledge are connected to form a continuous ledge and said second and fourth ledge are connected to form a continuous ledge.

3. The assembly of claim 1 further comprising:

a first and second sleeve, said first sleeve mounted above, concentric with and cocircumferential with said first bore, said second sleeve mounted above, coaxial with and cocircumferential with said second bore, said first and second flat positioned on the outside of said first sleeve and said third and fourth flat positioned on the outside of said second sleeve.

4. The assembly of claim 1 wherein the first, second, third, and fourth flat are positioned to face outwardly from said housing and the first, second, third, and fourth ledge are positioned to face inwardly in said housing.

5. The assembly of claim 1 wherein the distance between said first and second flat is substantially the same as the distance between said first and second ledge, and the distance between said third and fourth flat is substantially the same as the distance between said third and fourth ledge.

6. The assembly of claim 1 further comprising a hydraulic lash adjuster in each bore.

* * * * *